United States Patent [19]

Nagennast

[11] Patent Number: 4,592,281

[45] Date of Patent: Jun. 3, 1986

[54] ARMING AND FIRING DEVICE

[75] Inventor: Crosby O. Nagennast, Laverne, Calif.

[73] Assignee: Special Devices, Inc., Newhall, Calif.

[21] Appl. No.: 402,913

[22] Filed: Jul. 29, 1982

[51] Int. Cl.[4] ..... F42C 15/40; F42C 15/00

[52] U.S. Cl. ..... 102/254; 102/200; 102/221

[58] Field of Search ..... 102/200, 221, 254, 255, 102/256, 202.1, 202.3, 202, 202.5, 202.14, 251, 244, 235, 229, 275.2, 275.4

[56] References Cited

U.S. PATENT DOCUMENTS

| | | | |
|---|---|---|---|
| 3,209,692 | 10/1965 | Webb | 102/275.4 |
| 3,238,876 | 3/1966 | Allen | 102/275.4 |
| 3,311,058 | 3/1967 | Fohrmann et al. | 102/254 |
| 3,351,016 | 11/1967 | Simpson | 102/202.1 |
| 3,420,174 | 1/1969 | Potter | 102/202.1 |
| 3,500,747 | 3/1970 | Parker | 102/254 |
| 3,678,853 | 7/1972 | Kilmer | 102/275.4 |
| 3,945,322 | 3/1976 | Carlson et al. | 102/275.4 |
| 4,046,076 | 9/1977 | Hampton | 102/202 |
| 4,090,450 | 5/1978 | Nygards | 102/254 |
| 4,278,026 | 7/1981 | Hibbs | 102/254 |

FOREIGN PATENT DOCUMENTS

| | | | |
|---|---|---|---|
| 0030498 | 6/1981 | European Pat. Off. | 102/275.4 |
| 1276510 | 8/1968 | Fed. Rep. of Germany | 102/202.5 |
| 353311 | 12/1937 | Italy | 102/254 |

*Primary Examiner*—Charles T. Jordan

*Attorney, Agent, or Firm*—Robert Louis Finkel

[57] ABSTRACT

An improved arming and firing device especially suited for rocket motors. An explosive donor charge is packed against a bulkhead formed in the body of the device. Shock energy generated by the donor charge and transmitted through the unruptured bulkhead sets off a shock-responsive receptor charge, which in turn initiates a pyrotechnic or explosive rocket motor-actuating output charge. The bulkhead prevents blow-by or leakage of the rocket's combustion products. The donor charge is ignited by an electrically activated detonator. The detonator is carried by a moveable holder. The holder is moved against a return spring by electromechanical driving means. Arming the device is accomplished by moving the holder to position the detonator in firing train with the donor charge, thereby simultaneously bringing electrical contacts on the detonator into contact with electrical leads on a switch plate located adjacent the holder and thus closing the firing circuit. In the event of an abort or power failure, the return spring removes the detonator from the firing train, thereby breaking the firing circuit as well. A separate circuit is provided for shorting the detonator in the safe condition. Additional circuits may be provided for monitoring the status of the device. A viewing port may be provided for direct or remote visual observation of the condition of the device.

12 Claims, 7 Drawing Figures

FIG. 1
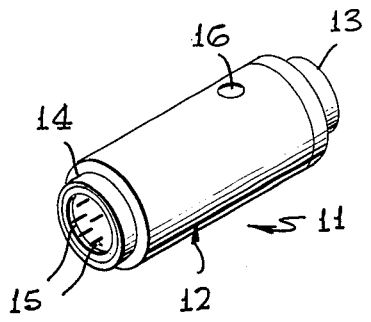
FIG. 2
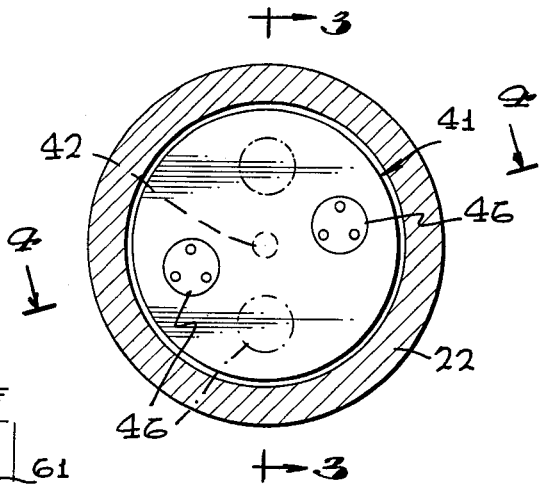
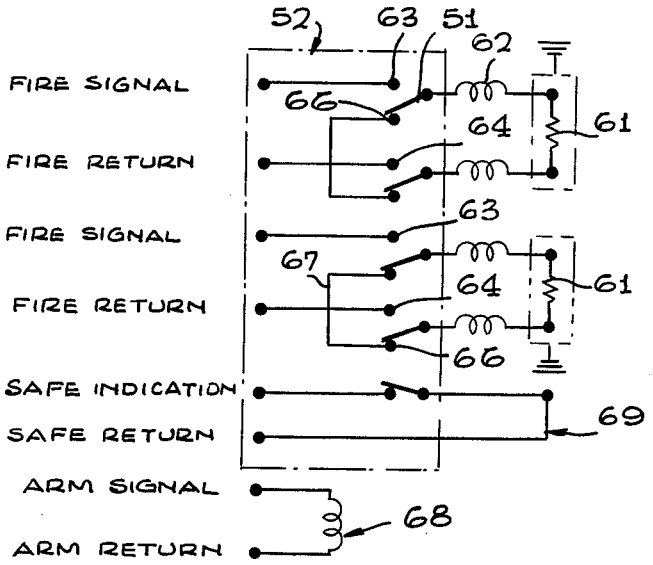
FIG. 5
FIG. 7
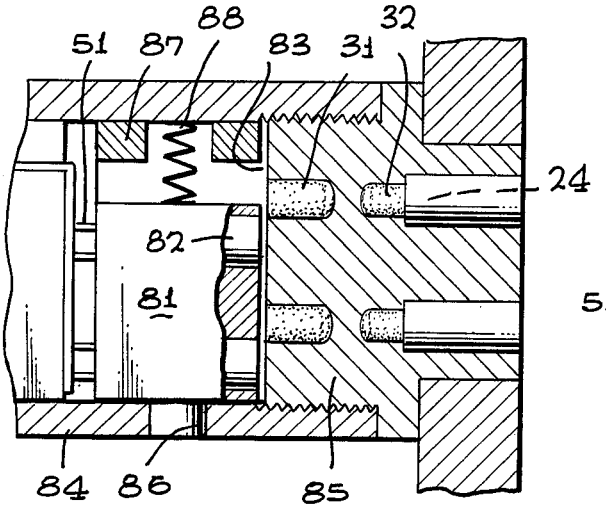
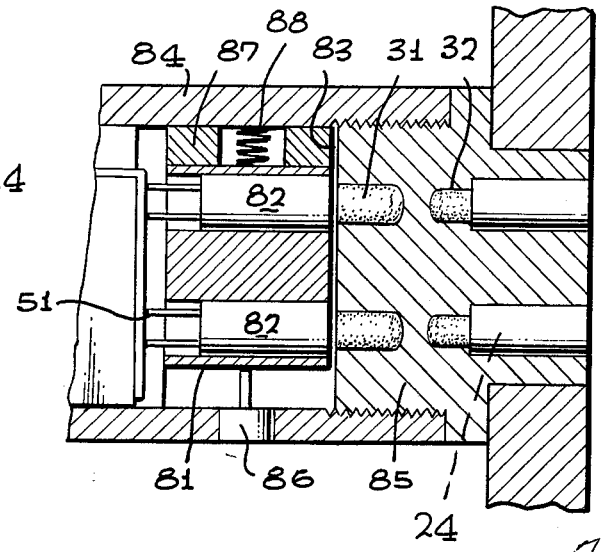
FIG. 6
7

ARMING AND FIRING DEVICE

BACKGROUND OF THE INVENTION

1. Field of the Invention

This invention relates to arming and firing devices in which a pyrotechnic or explosive output charge is actuated on command to initiate a reactive process, such as combustion in a rocket motor, or to energize an apparatus, such as a piston-operated mechanism. More particularly, it relates to devices of this type incorporating means for preventing accidental or inadvertent actuation of the output charge. Still more particularly, it concerns arming and firing devices for rocket motors adapted to prevent the passage, by blow-by or leakage, of contaminating solid or gaseous rocket combustion products.

2. Prior Art

Safety fuses and other arming and firing devices employing explosive or pyrotechnic charges to initiate rocket motors, activiate explosive charges, actuate quick-release mechanisms and perform similar tasks are well known. Commonly such devices incorporate safety features designed to prevent premature firing. Some of these employ means for structurally completing a mechanical or chemical firing train in response to an arming command. Others rely on means for closing an electrical firing circuit. Still others utilize both structural and electrical arming means.

Generally, these prior art devices tend to be undesirably large and complex. Additionally, such devices are frequently exposed to environmental or operational conditions which require them to be sealed to prevent the passage of contaminants. By way of example, arming and firing devices for internal use in rocket-propelled guided missiles must be constructed to prevent the blow-by or leakage of rocket combustion products which would be harmful to the missile's guidance and firing systems. Conventionally, seals and O-rings are employed for this purpose. Devices relying on these, however, are difficult and costly to manufacture and are subject to unpredictable failure.

Recent advances in through-bulkhead initiation technology have led to the development of leak-proof firing devices. The construction of these devices, however, does not lend itself readily to the application of prior art safe-arm means for preventing their accidental or inadvertent firing.

BRIEF SUMMARY OF THE INVENTION

The subject invention combines a construction embodying the principles of through-bulkhead initiation with electromechanical arming means to provide an arming and firing device that is both leak-proof and secure against unintentional firing.

Externally the device takes the form of a gas-tight plug, which can be welded to, or made part of the casing of the rocket motor or other apparatus to be actuated, thus insuring against leakage from the surrounding environment. The body of the device includes an internal bulkhead, which prevents the passage of gases through the interior of the body.

Although one would suffice, for precautionary purposes the preferred embodiment of the invention is provided with a pair of identical redundant independently initiated explosive or pyrotechnic output charges.

A pair of shock-producing explosive donor charges are packed in intimate contact with the bulkhead and adapted to transmit shock waves through the bulkhead without breaching, or creating leak paths through or around it. A pair of shock-activated receptor charges, separated from the donor charges by the bulkhead, are positioned to initiate the respective output charges when the donor charges are fired.

Each donor charge is fired by an electrically actuated detonator. The detonators are carried by a holder mounted to the shaft of a rotary solenoid within the body of the device. An arming circuit energizes the solenoid to position the detonators in firing train with their respective donor charges, when an arming command is given. A return spring associated with the solenoid is adapted to remove the detonators from the firing train, in the event of a power failure or should the arming or firing sequence be aborted for any cause.

Parallel electrical circuits are provided for firing the detonators on command. As the holder is rotated to the armed position, contact fingers on the detonators are simultaneously brought into contact with leads on an adjacent switch plate to complete these circuits. The firing circuits are broken when the holder is rotated to the safe position. To minimize the possibility of accidental initiation of the detonators by R-F radiation or static buildup, the detonator contacts are positioned to engage an isolated shorting pad while the device is in the safe condition.

Separate electrical circuitry is provided for continuous remote monitoring of the condition of the device. Additionally, a port may be provided in the body of the device for direct visual observation of its status.

DESCRIPTION OF THE DRAWING

The construction and operation of the invention, and its advantages may be more fully understood by reference to the following detailed description of several of its preferred embodiments and the accompanying drawing, in which:

FIG. 1 is a rear perspective view of an arming and firing device embodying the subject invention;

FIG. 2 is an enlarged cross-sectional view of the device of FIG. 1, taken in the direction 2—2 of FIG. 3, showing the relative positions of the detonators when the device is in the safe condition and when it is in the armed condition;

FIG. 5 is a schematic view of the circuitry of the device of FIGS. 1-4;

FIG. 6 is a fragmentary side sectional view of an alternative embodiment of the subject invention in the safe condition; and FIG. 7 is a fragmentary side sectional view of the embodiment of FIG. 6 in the armed condition.

DETAILED DESCRIPTION OF THE PREFERRED EMBODIMENTS

Figure 3:
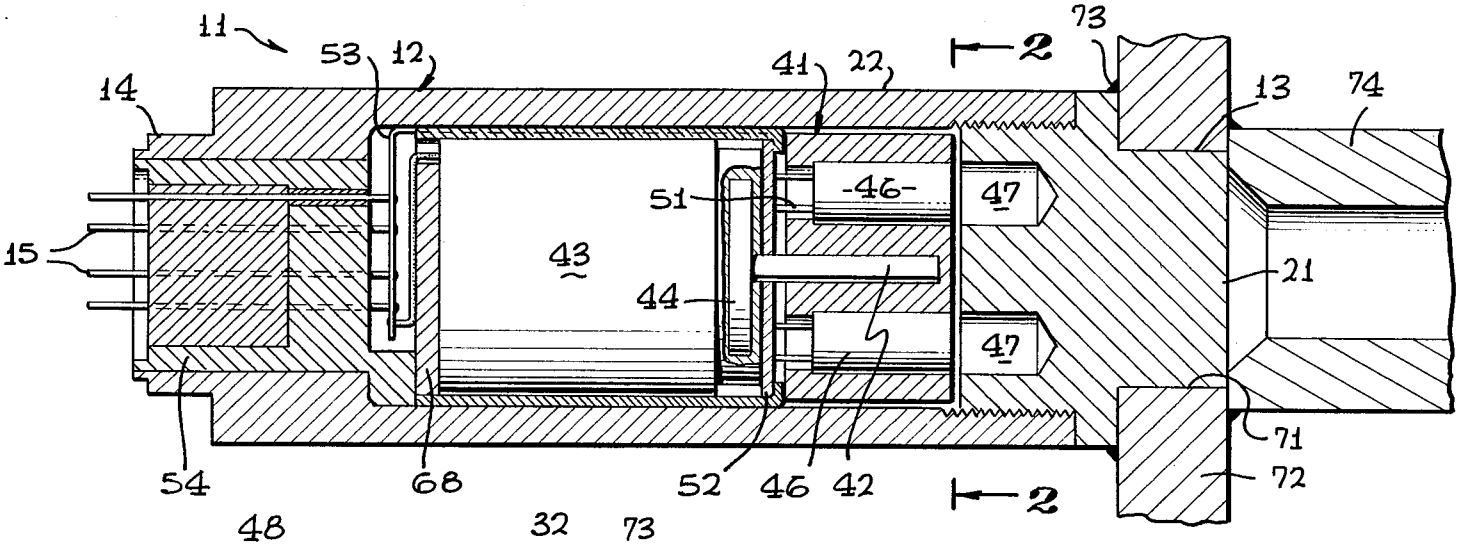
FIG. 3 is a side sectional view of the embodiment of FIG. 2 in the safe condition, taken in the direction 3—3, showing the device mated to a typical casing.

Referring to FIG. 1, a preferred embodiment of the subject invention is an arming and firing device 11 having a generally cylindrical body 12. The forward, or output end 13 of body 12 is conventionally adapted for mating with the apparatus to be initiated, for example a missile rocket motor (not shown). Its rear end 14 is likewise adapted for mating with an electrical connector (not shown) fitted to receive terminal pins 15. A viewing port 16 is provided for visual observation of the condition of the device.

Figure 4:
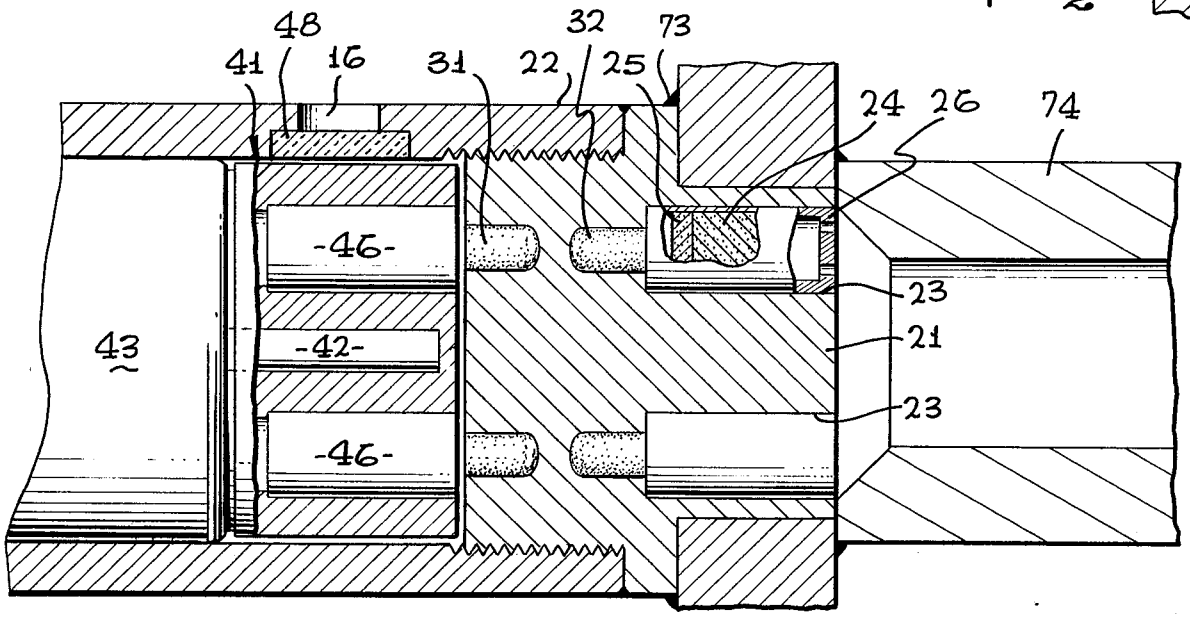
FIG. 4 is a side sectional view of the embodiment of FIG. 3 in the armed condition, taken in the direction 4—4 of FIG. 2.

As best seen in FIGS. 2–4, the body 12 is most conveniently constructed by securing a solid bulkhead 21 to one end of housing 22, by welding or other conventional means, to form an integral, pressure-resistant plug.

A pair of recesses 23 are machined in the forward end of bulkhead 21 to receive a pair of output charge assemblies, including explosive or pyrotechnic output charges 24 and ignition charges 25. Baffles and perforated end caps 26 are inserted into the recesses 23 to enclose their ends.

A pair of cavities are formed in the exposed rear end of bulkhead 21 in axial alignment with recesses 23 containing output charges 24, and a pair of shock-producing explosive donor charges 31 are tightly packed into them. A second pair of cavities formed at the ends of recesses 23 adjacent the cavities containing charges 31 are packed with shock-activated explosive or pyrotechnic receptor charges 32. Bulkhead 21 forms a gas-impenetrable barrier between donor charges 31 and receptor charges 32. The configuration of the cavities containing donor charges 31, the strength of those charges, the spacing between donor charges 31 and receptor charge 32, and various other parameters are selected, in accordance with well known criteria, to insure the shock waves generated by donor charges 31 and transmitted through bulkhead 21 will initiate receptor charges 32, without rupturing or creating leak paths through bulkhead 21. Receptor charges 32 are likewise carefully selected to insure their limitation of output charges 24.

A holder, preferably in the form of a cylinder 41, is secured to the shaft 42 of an electromechanically operated rotary drive, such as rotary solenoid 43, which is securely anchored within housing 22. Cylinder 41 is sized to rotate freely within housing 22 under the influence of solenoid 43. Resilient means, such as coiled return spring 44 connected between shaft 42 and housing 22, oppose the rotation of solenoid 43.

A pair of cavities are formed in the front face of cylinder 41 and hold a pair of electrically-actuated detonators 46 in registry with donor charges 31. Detonators 46 are adapted to actuate donor charges 31 upon receipt of an electrial firing command. A pair of cavities 47 are formed in the rear face of bulkhead 21, in registry with detonators 46 and displaced circumfrentially from donor charges 31.

Conventional motion-arresting means (not shown), such as two sets of abutting shoulders formed on cylinder 41 and the inner wall of housing 22, limit the freedom of rotary movement of cylinder 41. Thus while solenoid 43 is inactive, return spring 44 maintains cylinder 41 in the "safe" position illustrated in FIG. 3, and when solenoid 43 is enerigized by an electrical arming command, it overcomes the force exerted by spring 44 and rotates cylinder 41 and detonators 46 into the "armed" position illustrated in FIG. 4. When the current to solenoid to 43 is interrupted, spring 44 returns cylinder 41 and detonators 46 to the "safe" position. With appropriate position-indicating markings on the circumference of cylinder 41, viewing port 16, sealed by transparent, pressure-resistant window 48, provides means for direct visual observation of the condition of the device.

Resilient electrically conductive contact fingers 51 extend rearwardly from detonators 46 and project outwardly of the rear face of cylinder 41. Fingers 51 are maintained in sliding contact with a switchplate 52 conventionally secured to housing 22. A conductive flex print 52 is connected between switchplate 52 and pins 15, which extend through the insulated header assembly 54 sealing the rear end of housing 22. Pains are taken to insulate the electrical circuitry, solenoid 43, and detonators 46 against spurious R-F, as well as electrical signals.

FIG. 5 illustrates schematically the basic circuitry employed in the embodiments of FIGS. 3 and 4. Each of the detonators 46 is actuated by a casegrounded bridgewire 61, whose leads are protected by inductive R-F filters 62. Conductive pads 63, 64 on switchplate 52 serve as fire signal and fire return leads, respectively. Pads 66 are connected to separate, isolated shorting circuits 67, which further protect the detonator circuits from excitation by R-F radiation. Contact fingers 51 are arranged to contact pads 63, 64 only when the device is in the "armed" condition of FIG. 4, and to contact pads 66 when the device is in the "safe" condition illustrated in FIG. 3. An arming circuit 68, physically separated from switchplate 52, actuates rotary solenoid 43 on receipt of an arming command signal. A separate and distinct circuit 69 on switchplate 52 is adapted to continuously monitor the condition of the device.

As illustrated in FIGS. 3 and 4, the output end of the arming and firing device is inserted through an opening 71 formed in the casing 72 of a missile rocket motor. A continuous weld 73 around the circumference of the body 12 seals the casing 72 against the entry of gases and moisture from the external environment. An adapter 74 may be used, if necessary, to direct the blast of output charges 24 to the rocket motor (not shown). Bulkhead 21 prevents the rocket's combustion products from passing through the body of the arming and firing device.

FIGS. 6 and 7 illustrate an alternative embodiment of the subject invention. In this device the moveable holder 81 containing detonators 82 is in the form of a slab or block adapted to reciprocate linearly, rather than rotationally as in the embodiment of FIGS. 3–5, in a channel 83 extending transversely of housing 84 at the rear face of bulkhead 85. A linear solenoid 86 drives holder 81 against stop 87 in response to the arming command signal. In this position detonators 82 are in firing train with donor charges 31. In the event the current to solenoid is interupted for any reason, return spring 88 forces holder 81 into the "safe" position at the opposite end of channel 83. Here, once again, detonators 82 are out of alignment with donor charges 31. With the firing train thus broken, even the accidental initiation of one or both of the detonators 82 cannot actuate donor charges 31, receptor charges 32, or output charges 24. In all other respects the construction and operation of this embodiment of the invention are substantially identical to those previously described in connection with the embodiment of FIGS. 3–5.

It will be understood that the particular forms and details of construction shown and described here have been chosen for illustrative purposes and are not intended to limit the scope of the invention as it is defined by the following claims.

I claim:

1. An arming and firing device, comprising:

a body, defining an integral gas-impenetrable plug, having a pyrotechnic or explosive output charge at one end thereof and an internal bulkhead preventing the passage of gasses therethrough;

a shock-producing donor charge packed in intimate contact with the bulkhead and adapted to transmit a shock wave through the bulkhead without rupturing the bulkhead;

a shock-activated receptor charge separated from the donor charge by the bulkhead and adapated to initiate the output charge in response to initiation of the donor charge;

a holder moveable within the body;

a detonator carried by the holder;

arming means including means for moving the holder and thereby selectively positioning the detonator alternatively in or out of firing train with the donor charge; and firing means in interruptable communication with the detonator for actuating the detonator on command and thereby initiating the donor charge, said firing means including electrical leads and an isolated shorting pad mounted to the body, and electrical contacts associated with the detonator and adapted to make electrical contact alternatively with the leads or the shorting pad in response to movement of the holder.

2. The arming and firing device of claim 1 wherein the holder is adapted for rotational movement within the body.

3. The arming and firing device of claim 2 wherein the arming means comprises electromechanical means adapted to rotate the holder.

4. The arming and firing device of claim 1 wherein the holder is adapted for linear reciprocating movement within the body.

5. In an arming and firing device including a body defining an integral gas-impenetrable plug, said body having a pyrotechnic or explosive output charge at one end thereof and an internal bulkhead preventing the passage of gasses therethrough; a shock-producing donor charge packed in intimate contact with the bulkhead and adapted to transmit a shock wave through the bulkhead without rupturing the bulkhead; and a shock-activated receptor charge separated from the donor charge by the bulkhead and adapted to initiate the output charge in response to initiation of the donor charge, the improvement comprising:

a holder moveable within the body;

a detonator carried by the holder;

arming means including means for moving the holder and thereby selectively positioning the detonator alternatively in or out of firing train with the donor charge; and firing means in interruptable communication with the detonator for actuating the detonator on command and thereby initiating the donor charge, said firing means including electrical leads and an isolated shorting pad mounted to the body, and electrical contacts associated with the detonator and adapted to make electrical contact alternatively with the leads or the shorting pad in response to movement of the holder.

6. The improvement of claim 5 wherein the holder is adapted for rotational movement within the body.

7. The improvement of claim 6 wherein the arming means comprises electromechanical means adapted to rotate the holder.

8. The improvement of claim 5 wherein the plug is adapted for linear reciprocating movement within the body.

9. In combination with a device actuated by a pyrotechnic or explosive charge, an arming and firing device, comprising:

a body, defining an integral gas-impenetrable plug, having a pyrotechnic or explosive output charge at one end thereof and an internal bulkhead preventing the passage of gasses therethrough;

a shock-producing donor charge packed in intimate contact with the bulkhead and adapted to transmit a shock wave through the bulkhead without rupturing the bulkhead;

a shock-activated receptor charge separated from the donor charge by the bulkhead and adapted to initiate the output charge in response to initiation of the donor charge;

a holder moveable within the body;

a detonator carried by the holder;

arming means including means for moving the holder and thereby selectively positioning the detonator alternatively in or out of firing train with the donor charge; and firing means in interruptable communication with the detonator for actuating the detonator on command and thereby initiating the donor charge, said firing means including electrical leads and an isolated shorting pad mounted to the body, and electrical contacts associated with the detonator and adapted to make electrical contact alternatively with the leads or the shorting pad in response to movement of the holder.

10. The combination of claim 9 wherein the holder is adapted for rotational movement within the body.

11. The combination of claim 10 wherein the arming means comprises electromagnetic means adapted to rotate the holder.

12. The combination of claim 9 wherein the holder is adapted for linear reciprocating movement within the body.

* * * * *

UNITED STATES PATENT AND TRADEMARK OFFICE

CERTIFICATE OF CORRECTION

PATENT NO. : 4,592,281

DATED : 3 June 1986

INVENTOR(S) : Crosby O. Nagengast

It is certified that error appears in the above—identified patent and that said Letters Patent is hereby corrected as shown below:

On the title page, the name of the Inventor should read:

-- Crosby O. Nagengast--.

Signed and Sealed this

Seventh Day of October, 1986

[SEAL]

*Attest:*

DONALD J. QUIGG

*Attesting Officer*

*Commissioner of Patents and Trademarks*